US006518583B1

(12) United States Patent
Hennig

(10) Patent No.: US 6,518,583 B1
(45) Date of Patent: Feb. 11, 2003

(54) OPTICAL EXPOSURE DEVICE IN PARTICULAR A UV TABLE LAMP FOR HARDENING LIGHT-HARDENING GEL IN THE COURSE OF FINGERNAIL TREATMENT

(75) Inventor: Manfred Hennig, Bundesrepublik (NL)

(73) Assignee: Professional Products M. Naumann GmbH, Bochum (DE)

( * ) Notice: Subject to any disclaimer, the term of this patent is extended or adjusted under 35 U.S.C. 154(b) by 0 days.

(21) Appl. No.: 09/461,864

(22) Filed: Dec. 15, 1999

(30) Foreign Application Priority Data

Jan. 16, 1999 (DE) ..... 199 01 589

(51) Int. Cl.[7] ..... G01J 1/00
(52) U.S. Cl. ..... 250/504 R
(58) Field of Search ..... 250/292.1, 504 R, 250/493.1; 34/275, 202, 426, 1 Y

(56) References Cited

U.S. PATENT DOCUMENTS 5,130,551 A 7/1992 Nafziger et al.
5,249,367 A * 10/1993 Nifziger et al. ..... 34/1
5,515,621 A * 5/1996 Bloom ..... 34/275

* cited by examiner

*Primary Examiner*—John R. Lee
*Assistant Examiner*—Johnnie L Smith
(74) *Attorney, Agent, or Firm*—Collard & Roe. P.C.

(57) ABSTRACT

The invention relates to an optical exposure device in particular an UV table lamp, for hardening light-hardening gel in the course of finger nail treatment. In its basic design, this optical exposure device has at least one UV light source (1) and a light source housing (2). There are provided in this case two or more UV light sources (1) which are arranged in a V-shaped fashion and are arranged above a bearing surface (AF), of essentially convex curvature, for a hand with finger nails to be treated. The overall result is to achieve a configuration which is cost effective and of simple design.

15 Claims, 4 Drawing Sheets

OPTICAL EXPOSURE DEVICE IN PARTICULAR A UV TABLE LAMP FOR HARDENING LIGHT-HARDENING GEL IN THE COURSE OF FINGERNAIL TREATMENT

The invention relates to an optical exposure device, in particular a UV table lamp, for hardening light-hardening gel in the course of finger nail treatment, having at least two UV light sources which are arranged in a V-shaped fashion and are arranged above a bearing surface for a hand with the finger nails to be treated, and define a common light source plane, and having a light source housing.

An optical exposure device of the design described at the beginning has been disclosed by DE 37 27 916 C2. The radiating source implemented here is designed symmetrically relative to the housing longitudinal plane and describes an arcuate section of at least 180° with the opening of the arcuate section pointing towards the insertion opening. The aim of this is for the optical exposure to be limited essentially to the region of the finger nails and otherwise to be able to provide it uniformly both for the left hand and for the right hand.

Other optical exposure devices are described in DE-U 86 09 293, DE-U 298 08 796 and U.S. Pat. No. 5,130,551. Moreover, optical exposure devices are used in practice to harden an light-hardening gel in the course of finger nail treatment. These operate generally in such a way that all (five) finger nails of one hand can be treated simultaneously. For this purpose, the optical exposure devices known in practice are constructed as tunnels and are equipped with at least four UV light sources, as is described in principle in DE-U 86 09 293 already mentioned above.

In order to supply these light sources with power it is regularly necessary to have recourse to two or more reactance coils which act as AC resistor and convert the system voltage present (regularly approximately 230 V or 110 V) into a suitable operating voltage (usually approximately 60 V to 100 V). In any case, the design outlay is high. Resulting from this there is also a high production cost which is explained, in particular, by the use of four UV light sources which are expensive owing to their special equipment for the intended use. A comparable statement holds for DE 37 27 916 C2, whose radiating source has a complicated shape and is likewise represented by at least four individual tubes. The invention is intended to provide an overall remedy here.

The technical problem on which the invention is based is to develop an optical exposure device of the generic type such that said device is of a design configuration which is simpler (than the previously known prior art), operates in a particularly power-saving fashion and permits mounting to be easy and quick. Overall, the production costs are intended to be substantially reduced.

In order to achieve this object, the invention proposes in the case of an optical exposure device of the generic type that the bearing surface (for the hand with the finger nails to be treated) is of convex curvature, and that the (only two) UV light sources are inclined with respect to the light source plane, the associated angle of inclination assuming values of between approximately 30° and 60°. Of course, it is also possible to implement more than two UV light sources within the scope of the invention, although this is not expressly necessary. Rather, it has emerged that by comparison with the prior art (four UV light sources), it is possible virtually to halve the number of light sources required within the scope of the invention without observing any losses in quality in the finger nail treatment or a lengthening of the treatment period. This can be ascribed essentially to the fact that the bearing surface is of convex curvature and the two UV light sources have the described inclination with respect to the light source plane defined.

As a rule, the V angle enclosed by the UV light sources can have values from 30° to 60°,preferably approximately 45°. The vertex of the V angle is generally arranged in an extension of the finger nails to be treated. The angle of inclination of the two UV light sources with respect to the light source plane defined is preferably approximately 45°.

As a result, in combination with the bearing surface of convex curvature this special arrangement of the two UV light sources achieves the desired effect of reducing costs and simplifying design. The point is that the arrangement is made such that the vertex of the abovenamed V angle is generally arranged in the region of the longest finger tip (middle finger). The V shape in this case ergonomically matches the five finger tips forming a V-shaped envelope, with the result that the exposure exactly follows the natural position of the finger nails. As a result, the light-hardening gel can be hardened in a pinpoint and an effective fashion.

The light source plane is principally of horizontal alignment and arranged at a prescribed parallel spacing above the bearing surface. If the two UV light sources—generally with the same angle of inclination—are tilted or inclined with respect to the light source plane in a fashion facing one another, the result is that they enclose in a respective extension a head angle of a triangle having the angles of inclination as base angles. It is particularly advantageous when the two UV light sources are constructed as U-shaped gas discharge lamps with a foot designed as a plug-in unit. The point is that this foot can then be pushed into a slotted receptacle of a housing web for respectively positioning the UV light source. Consequently, the result of this is not only that the mounting is simplified (because a simple plug-in unit is implemented), but additionally that—as it were, automatically—the described positioning according to the invention of the two light sources is also achieved. The housing web previously described can be stabilized by means of lateral steel inserts. The latter can, for example, be inserted into associated web pockets, or be bonded, riveted or connected in a comparable way to the housing web. Because they are fitted near the circumference on a housing base of the light source housing, these steel inserts increase the tilting moment of said housing, and thus the stability.

Use is made as voltage supply for the two UV light sources of an external plug-in ballast with a dedicated plug housing and at least one built-in reactance coil as AC resistor. As a result, the design outlay is reduced once again, precisely because it is possible only to have recourse to a single reactance coil as AC resistor, and there is no need for a plurality of devices of this type as required in the prior art. Moreover, a timer module can be fed from the supply voltage for the UV light sources. Said module serves for automatically switching off the UV light sources after a selectable treatment time. Consequently, comfort functions can be represented unchanged in conjunction with an extremely simple design.

The light source housing for the optical exposure device described is for the most part designed in two parts with a housing base and housing hood. The two abovenamed components can have a round to elliptical base surface, with the result that a shapely, futuristic appearance is achieved over all. The outlay in terms of production is reduced once again by virtue of the fact that, according to a preferred embodiment, the housing base and housing hood are latched with one another. Of course, other connections, for example screwed or bonded connections are also conceivable. The two above-mentioned components are designed as plastic injection molded parts in order to permit quick and flexible production in conjunction with low costs. The housing hood has an insertion opening in the shape of a circular arc for the hand to be laid down in order to render it possible for the hand or the fingernails thereof which are to be treated to be inserted acceptably into the light source housing and laid down therein.

The bearing surface of convex curvature has a central support, of convex cross section, for the back of the hand and two finger support webs on both sides so that the hand can be laid down without being cramped, the previously described V shape of the finger nails automatically resulting. In addition, it is achieved hereby, in particular, that the outer fingers with the associated fingernails, that is to say the small finger and thumb, assume an exposed position, in particular are not negatively influenced as regards the light intensity by virtue of the other fingers casting a shadow or the like.

The previously named finger support webs can directly adjoin the central support for the back of the hand with bearing ramps. Usually, the bearing surface (in conjunction with the finger support webs) is constructed in plan view is an essentially elliptical fashion and with mirror symmetry relative to a major axis (of the ellipse), so that, as a result, the same exposure conditions are to be noted when treating the left and right hands. In any case, the finger support webs regularly take over the task of serving as support for the small finger and the thumb, or vice versa, depending on whether the left or the right hand is being treated. The exposed position of the latter, and the additional support ensure that, in conjunction with the V-shaped arrangement of the two UV light sources intensities of light and/or exposure which are comparable over all with regard to the V angle and the angle of inclination, are present in the region of each individual finger nail. This leads to uniform and quick hardening of the light-hardening gel applied.

All the previously described effects and actions are achieved in conjunction with the construction of extremely simple design, and with economic production, with the result that substantial cost advantages are to be noted by comparison with the prior art. Again, the recourse to only two UV light source reduces the development of heat. At the same time, scattering effects or other electromagnetic interference are minimized. This is where the essential advantages of the invention are to be seen.

The invention will be explained in more detail below with the aid of the following drawings which represent only an exemplary embodiment:

The figures represent an optical exposure device according to the exemplary embodiment of a UV table lamp for hardening light-hardening gel in the course of finger nail treatment. In its basic design, this optical exposure device has two UV light sources 1 arranged in a V-shaped fashion, and a light source housing 2. The two UV light sources 1 serve the purpose of achieving polymerization of the light-hardening gel by means of irradiation, as described, in principle, in DE-U 298 08 796 already mentioned at the beginning. Reference is expressly made thereto. It remains to mention as quintessence that the hardened gel permits the is overall construction of an artificial finger nail extension, the natural nail and, if appropriate, the gel as connecting means to be modeled without any problem.

Figure 2:
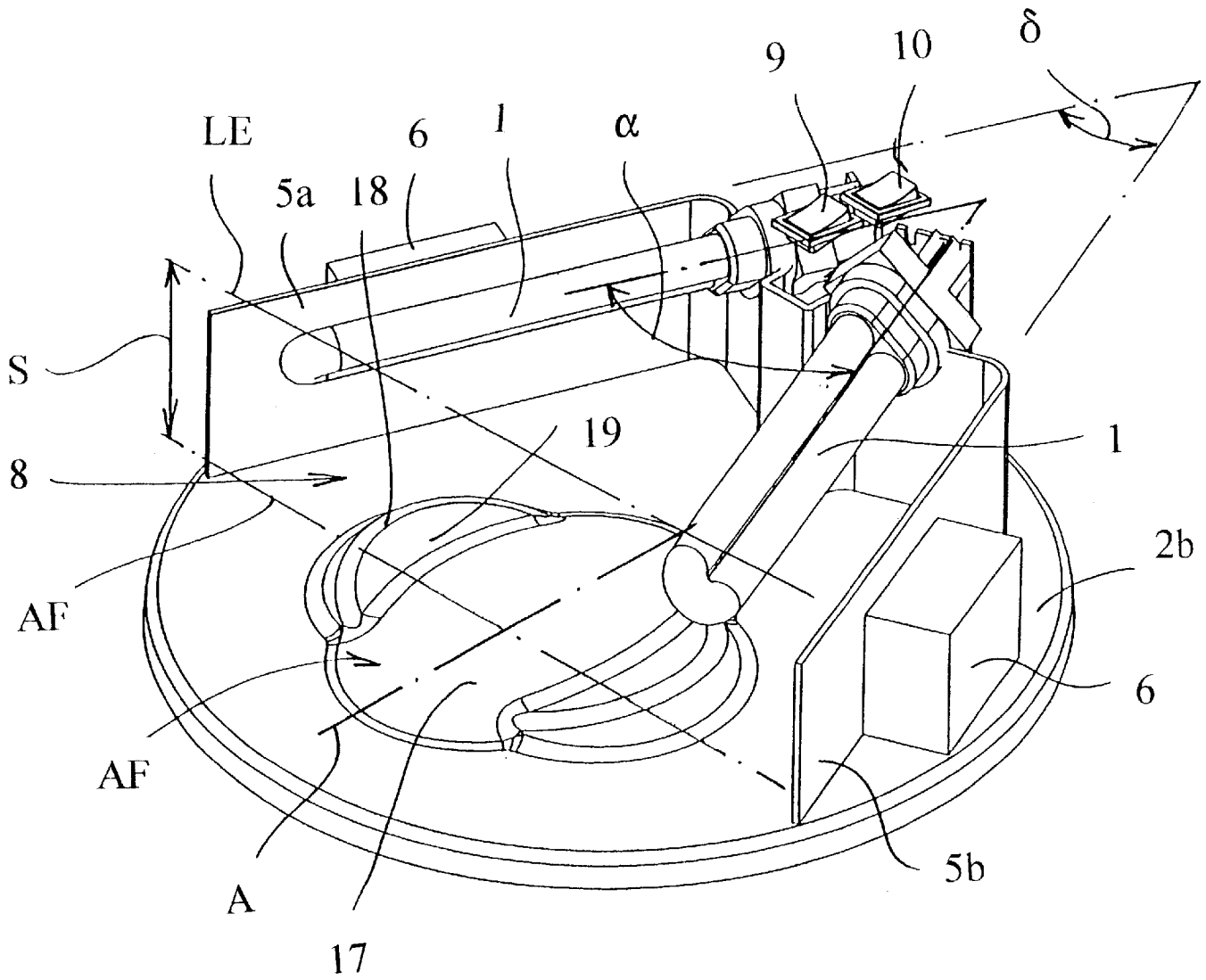
FIG. 2 shows the subject matter according to FIG. 1 with the housing hood removed.
Figure 3:
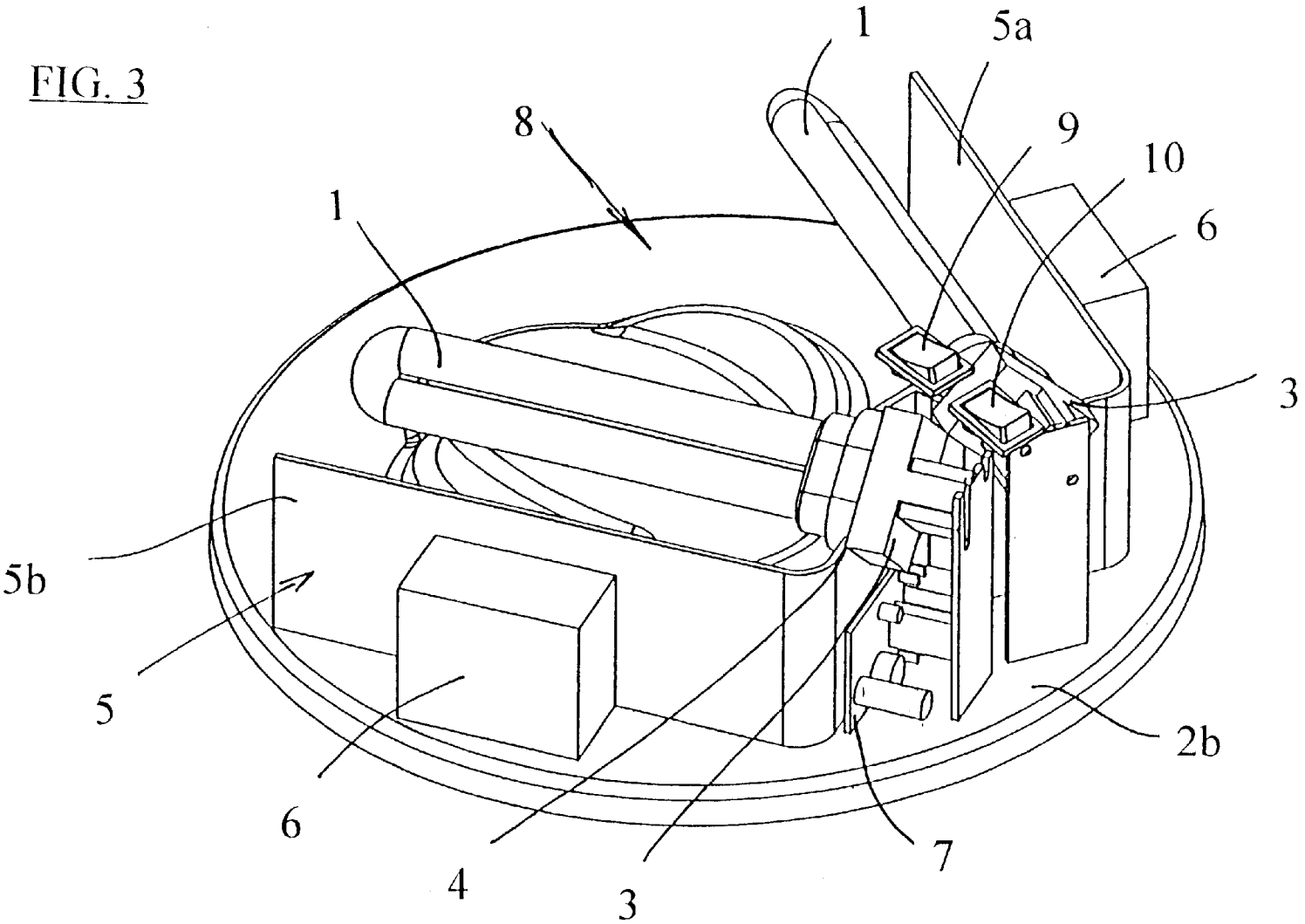
FIG. 3 shows another view of the subject matter according to FIG. 2.

The two UV light sources 1 arranged in a V-shaped fashion are arranged above a bearing surface AF, essentially of convex curvature, for the hand with the finger nails to be treated. In particular, it is to be seen in FIG. 4 that the two UV light sources 1 define a common light source plane LE. They enclose between them a V angle of 30° to 60°, approximately 45° according to the exemplary embodiment, the associated vertex of this V angle $\alpha$ being situated in an extension of the finger nails to be treated (compare FIGS. 2 and 3). Moreover, the two UV light sources 1 are tilted or inclined in each case with a prescribed inclination with respect to the light source plane LE. The associated angle of inclination $\beta_1$, $\beta_2$ assumes values of between 30° and 60°. According to the exemplary embodiment, the two angles of inclination $\beta_1$, $\beta_2$ are designed to be of equal size and amount to approximately 45°, as FIG. 4 makes directly clear.

Figure 4:
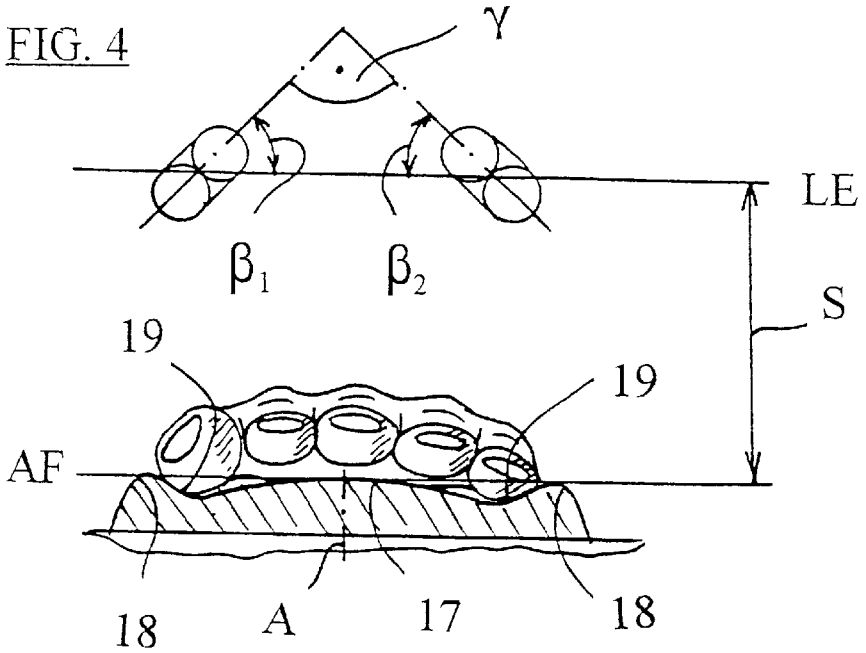
FIG. 4 shows a section through the subject matter according to FIG. 1 in the region of the bearing surface.

It may also be gathered from this graphic representation that the light source plane LE is aligned horizontally and is arranged at a prescribed parallel spacing S above the bearing surface AF. Because both UV light sources 1 have the same angle of inclination $\beta_1$, $\beta_2$ with respect to the light source plane LE ad are tilted facing one another with respect to the light source plane LE, a head angle $\gamma$ of a triangle such as is indicated by dots and dashes in FIG. 4 is produced in their respective extensions. The two angles of inclination $\beta_1$ and $\beta_2$ of equal size belong as base angles to this head angle $\gamma$ of the triangle indicated by dots and dashes. Since these base angles are in each case approximately 45°, the head angle $\gamma$ is a right angle.

The two UV light sources 1 are designed as U-shaped gas discharge lamps with a foot 3 designed as a plug-in unit. The two UV light sources 1 or the U-shaped gas discharge lamps operate chiefly on the basis of UV emissions of phosphor in the region of approximately 350 to 360 nm. The mounting of the foot 3, and thus of the UV light sources 1 is performed in such a way that the respective foot 3 is pushed into a slotted receptacle 4 of a housing web 5 for respectively positioning the UV light source 1. In this case, a circumferential groove (not expressly represented) is provided in the foot 3 and cooperates with the slotted receptacle 4 to fix the UV lamp 1 irrotationally. In any case, as a result of this the UV lamp 1 is mounted and positioned in one work step and is held captively in the housing web 5 as soon as a housing hood **2*a* has been mounted on the housing base 2*b* to be seen in FIGS. 2 and 3. This is achieved by virtue of the fact that the housing hood 2*a* is equipped with a mating housing web whose shape is comparable to the housing web 5. In any case, after uniting the housing base 2*b* and housing hood 2*a* the two UV light sources 1 are held captively and exactly positioned in the respective slotted receptacle 4**.

In addition, steel inserts or steel attachments 6 are provided alongside the housing web 5. These steel inserts 6 can be screwed or bonded on the housing web 5, or otherwise connected to the latter. It is also possible for them to be pushed into a holding pocket of the housing web 5. In any case, the steel inserts 6 ensure stabilization of the housing web 5 against sagging. Because they are fitted near the circumference with regard to the housing base **2*b* and thus, of course, to the housing hood 2*a* as well, the tilting moment of the entire light source housing 2** is increased. This leads to a simultaneous increase in the stability of the optical exposure device represented.

Figure 5:
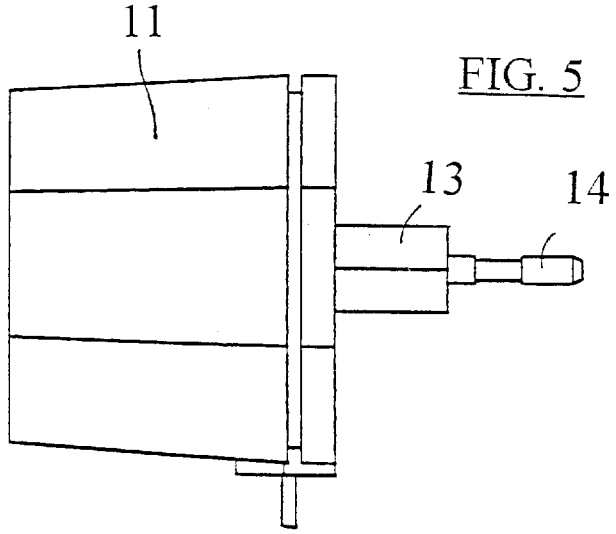
FIG. 5 shows the power supply device for the optical exposure device.

Also to be seen in addition to the two steel inserts 6 is a timer module 7 which serves the purpose of automatically disconnecting the UV light sources 1 after a selectable treatment time. This timer module 7 can be fed from the supply voltage for the UV light sources 1, as is yet to be explained in detail with reference to FIGS. 5 and 6. It is to be seen that the timer module 7—just like the two steel inserts 6—are arranged on the respective outer side of the housing web 5, which, as it were, defines a closed treatment space 8. In any case, as a result of this arrangement the abovenamed components 6, 7 cannot be seen from outside when the housing hood 2*a* is mounted, and therefore do not impair the appearance. Two switches 9, 10 serve, on the one hand, as mains on-off switches and, on the other hand, as pushbuttons for starting the UV lamps 1.

Recourse is made to an external plug-in ballast with a dedicated plug housing 11 for the voltage supply of the two UV light sources 1. This plug housing 11 has at least one built in reactance coil 12 as AC resistor. The above-mentioned plug housing 11 is equipped with an integrally formed extension 13 with plug pins 14 on the extension side (compare FIG. 5).

Figure 6:
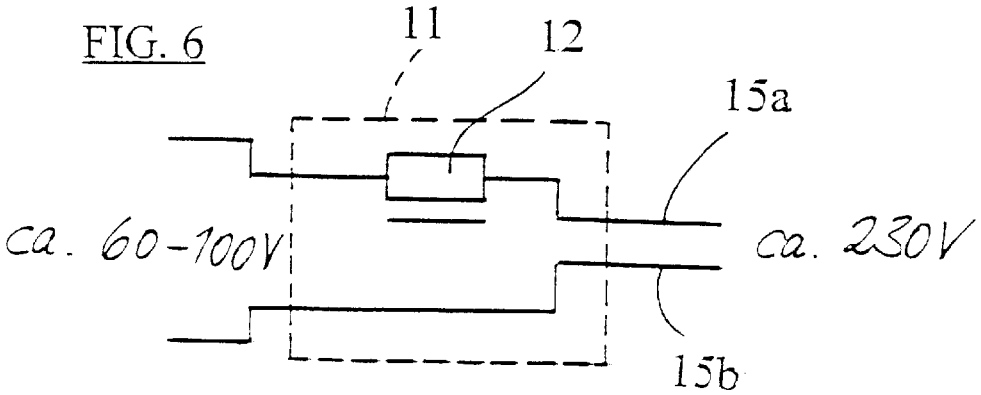
FIG. 6 shows a simplified sketch of the voltage supply according to FIG. 5.

It is clear from FIG. 6 that the reactance coil 12 (with indicated magnet) is provided in one phase conductor 15*a* of the two phase conductors 15*a,* 15*b.* In this way, the mains voltage on the input side of approximately 230 V is reduced to the required operating voltage of approximately 60 V to 100 V for the UV light sources 1. As already indicated, the supply voltage, on the secondary side, as it were, for the two UV light sources 1 is simultaneously used to feed the timer module 7.

Figure 1:
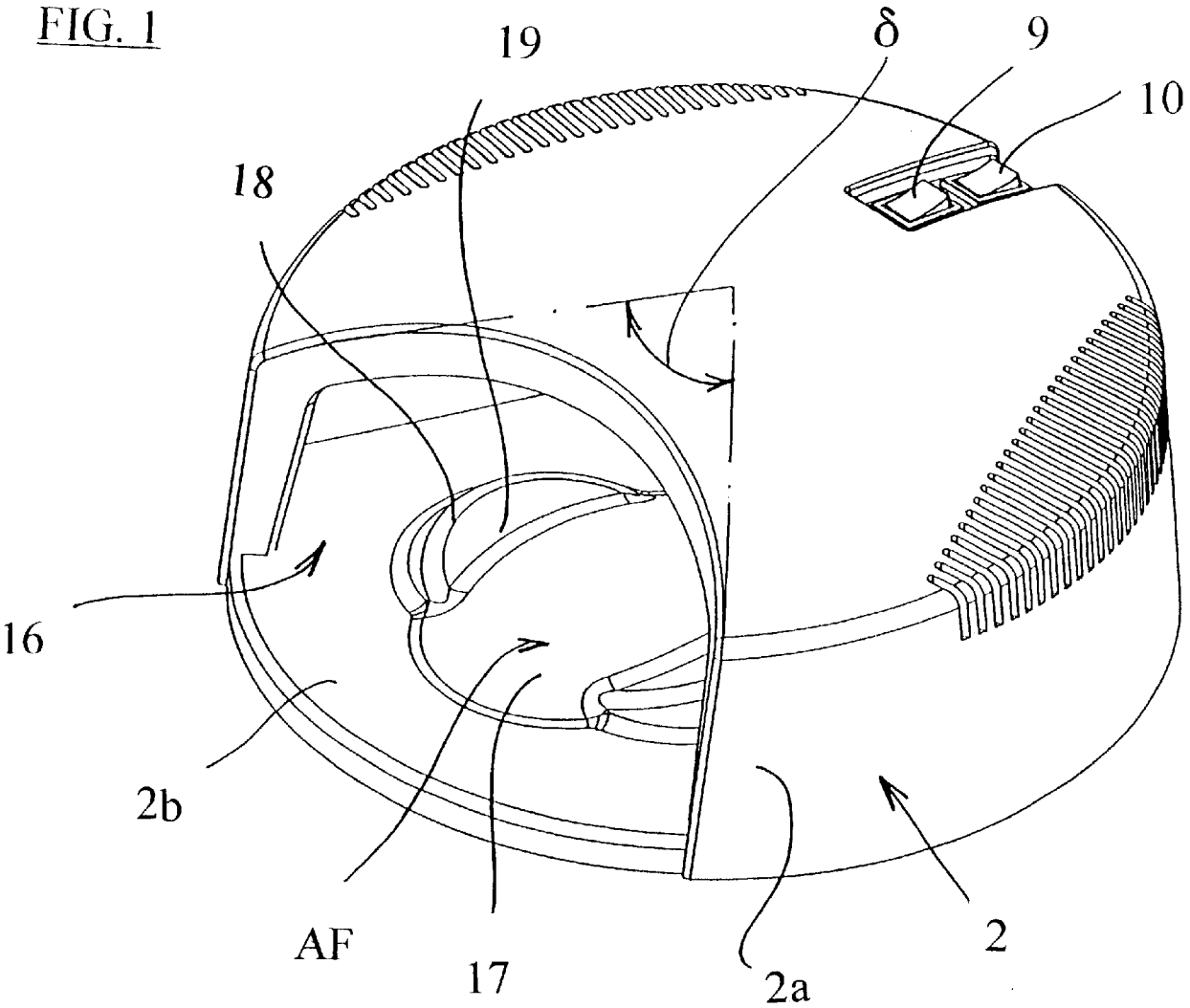
FIG. 1 shows a perspective view of an optical exposure device according to the invention.

The represented bipartite light source housing 2 comprising the housing base 2*b* and housing hood 2*a* is made from impact-resistant plastic, for example from ABS (acrylonitrile-butadiene-styrene). Both previously mentioned components 2*a,* 2*b* have a round to elliptical base surface. The housing base 2*b* and housing hood 2*a* are designed to latch with one another and designed in each case as plastic injection molded parts. As may be seen from FIG. 1, the housing hood 2*a* has an insertion opening 16 in the shape of a circular arc for the hand to be laid down on the bearing surface AF. The associated opening angle δ of this insertion opening 16 in the shape of a circular arc is adapted to the opening angle δ of the housing web 5 or its two V limbs 5*a,* 5*b,* with the result that the components (steel inserts 6 and timer module 7) located on its rear cannot be seen with the housing hood 2*a* mounted on the housing base 2*b,* and do not impair the external appearance.

The bearing surface AF of convex curvature has in cross section a convex, central support 17 for the back of the hand and two support webs 18 on both sides. With bearing ramps 19, these finger support webs 18 respectively directly adjoin the above-mentioned central support 17 for the back of the hand. The bearing surface AF is constructed in plan view in an essentially elliptical fashion and with mirror symmetry relative to a major axis A (of the ellipse), and this is shown, in particular, by FIGS. 3 and 4.

What is claimed is:

1. An optical exposure device, for hardening light-hardening gel in the course of finger nail treatment, comprising:

a light source housing;

a light source plane disposed horizontally across said light source housing;

at least two U-shaped light sources disposed in said light source housing and arranged in a V-shaped fashion in said light source plane and tilted toward one another with respect to said light source plane; and a bearing surface disposed horizontally parallel below said at least two UV light sources and said light source plane and having a convex surface for a hand with the finger nails to be treated;

wherein the angle of inclination of said at least two light sources has a value between 30° and 60°; and wherein said at least two U-shaped light sources are tilted so that the UV rays are directed toward said bearing surface maximizing the intensity at said bearing surface.

2. The optical exposure device of claim 1, wherein said at least two UV light sources have a V angle with a vertex formed by an extension of their lines in said light source plane in the direction of the material to be treated.

3. The optical exposure device of claim 1, wherein said angle of inclination has a value of approximately 45°.

4. The optical exposure device of claim 1, wherein said at least two UV light sources are inclined so that a respective extension of their lines forms a head angle of a triangle having the angles of inclination as base angles.

5. The optical exposure device of claim 1, wherein said at least two UV light sources are constructed as U-shaped gas discharge lamps, said device further comprising:

a foot designed as a plug-in unit; and a slotted receptacle of a housing web, wherein the foot is pushed into the slotted receptacle for respectively positioning said at least two UV light sources.

6. The optical exposure device of claim 5, further comprising:

a housing base; and lateral steel inserts, wherein said housing web is stabilized by said lateral inserts simultaneously increasing the tilting moment, and thus the stability of said light source housing by virtue of being fitted near the circumference on said associated housing base of said housing.

7. The optical exposure device of claim 1, said device further comprising:

at least one built-in reactance coil acting as AC resistor;

an external plug-in ballast, supplying voltage for said at least two UV light sources having a dedicated plug housing and at least one built-in reactance coil.

8. The optical exposure device of claim 7, further comprising a timer module, fed from said supply voltage for said at least two UV light sources, for automatically switching off said at least two UV light sources after a selectable treatment time.

9. The optical exposure device of claim 1, wherein said light source housing is of bipartite design with a housing base and a housing hood, wherein said housing base and said housing hood have a round to elliptical base surface.

10. The optical exposure device of claim 9, wherein said housing base and said housing hood are designed to latch with one another and as plastic injection molded parts.

11. The optical exposure device of claim 1, wherein, in plan view, said bearing surface is constructed in an essentially elliptical fashion and with mirror symmetry relative to a main axis.

12. The optical exposure device of claim 9, wherein said housing hood has an insertion opening in the shape of a circular arc for the material to be laid on said bearing surface.

13. The optical exposure device of claim 12, wherein said material to be hardened is a light-hardening gel in the course of treatment of finger nails on a hand.

14. The optical exposure device of claim 13, further comprising;

a convex, central support in cross section of the convexly curved bearing surface; and two finger support webs on both sides of said curved bearing surface.

15. The optical exposure device of claim 14, wherein said finger support webs respectively directly adjoin said central support for the back of the hand.

* * * * *